US011318739B2

(12) United States Patent
Kodama

(10) Patent No.: US 11,318,739 B2
(45) Date of Patent: May 3, 2022

(54) INKJET RECORDING APPARATUS AND STORAGE MEDIUM STORING PROGRAM

(71) Applicant: BROTHER KOGYO KABUSHIKI KAISHA, Nagoya (JP)

(72) Inventor: Shoko Kodama, Anjo (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 58 days.

(21) Appl. No.: 17/036,600

(22) Filed: Sep. 29, 2020

(65) Prior Publication Data

US 2021/0094287 A1 Apr. 1, 2021

(30) Foreign Application Priority Data

Sep. 30, 2019 (JP) ..... JP2019-178791

(51) Int. Cl.

| | |
|---|---|
| ***B41J 2/045*** | (2006.01) |
| ***B41J 2/155*** | (2006.01) |
| ***B41J 3/01*** | (2006.01) |
| ***B41J 2/21*** | (2006.01) |

(52) U.S. Cl.

CPC ..... *B41J 2/04573* (2013.01); *B41J 2/04586* (2013.01); *B41J 2/155* (2013.01); *B41J 2/2135* (2013.01); *B41J 3/01* (2013.01)

(58) Field of Classification Search

CPC ..... B41J 2/04573; B41J 2/2135

See application file for complete search history.

(56) References Cited

U.S. PATENT DOCUMENTS

2002/0113985 A1* 8/2002 Tayuki ..... B41J 29/393 358/1.9

2011/0279500 A1* 11/2011 Mitsuki ..... B41J 2/04588 347/10

FOREIGN PATENT DOCUMENTS

JP H11-179894 A 7/1999

JP 2006-321065 A 11/2006

* cited by examiner

*Primary Examiner* — Julian D Huffman

(74) *Attorney, Agent, or Firm* — Scully, Scott, Murphy & Presser, PC

(57) ABSTRACT

A controller determines whether a first direction is perpendicular to an extending direction of a straight line portion in a boundary between recorded and non-recorded regions; determines whether a recording resolution in the first direction is lower than an image resolution; in response to determining that the first direction is perpendicular to the extending direction and that the recording resolution is lower than the image resolution, determines whether at least part of a predicted landing region is located outside a reference line; and in response to determining that the at least part of the predicted landing region is located outside the reference line, controls a head and a carriage to adjust ejection timing of an ink droplet forming the edge of the straight line portion such that a protruding area of an actual landing region of the ink droplet is smaller than a protruding area of the predicted landing region.

13 Claims, 10 Drawing Sheets

INKJET RECORDING APPARATUS AND STORAGE MEDIUM STORING PROGRAM

CROSS REFERENCE TO RELATED APPLICATIONS

This application claims priority from Japanese Patent Application No. 2019-178791 filed Sep. 30, 2019. The entire content of the priority application is incorporated herein by reference.

TECHNICAL FIELD

This disclosure relates to an inkjet recording apparatus configured to record an image and a storage medium storing program.

BACKGROUND

The standard for one-dimensional codes (bar codes) defines the ratio of the width of a bar and the space between two adjacent bars. If the ratio of the width of the bar and the space of the printed barcode image is out of the reference range, a reading error will occur. In order to prevent a reading error, when printing a barcode image on a recording medium such as paper, it is necessary to ensure the recording quality of the barcode image so that the ratio of the width of the bar and the space is within the reference range. This also applies to the two-dimensional code.

For example, there is disclosed an inkjet recording apparatus that performs printing while selecting a head for recording large dots for a solidly recorded area and selecting a head for recording small dots for a finely recorded area such as a barcode, based on information read from a recording medium. In addition, there is disclosed an inkjet printing apparatus including control means for reducing the amount of ink ejection of an inkjet print head when the presence of barcode information in print image information is detected. These techniques reduce the amount of ink ejection for a barcode image and suppress the bars from becoming excessively thick, thereby securing the recording quality of barcode images.

SUMMARY

According to one aspect, this specification discloses an inkjet recording apparatus. The inkjet recording apparatus includes a head, a carriage, a conveyor, a memory, and a controller. The head has a plurality of nozzles configured to eject ink droplets onto a recording medium. The head is mounted on the carriage. The carriage is configured to reciprocate in a first direction such that the head moves relative to the recording medium. The conveyor is configured to convey the recording medium in a second direction perpendicular to the first direction. The controller is configured to: extract an image resolution in the first direction of image data stored in the memory; determine, based on the image data, whether a straight line portion is included in a boundary between a recorded region and a non-recorded region of an image to be recorded on the recording medium; in response to determining that the straight line portion is included, determine whether the first direction is perpendicular to an extending direction of the straight line portion; determine whether a recording resolution in the first direction is lower than the extracted image resolution, the recording resolution being stored in the memory; in response to determining that the first direction is perpendicular to the extending direction and that the recording resolution is lower than the extracted image resolution, determine whether at least part of a predicted landing region is located outside a reference line, the predicted landing region being a landing region on the recording medium of an ink droplet forming an edge of the straight line portion of the recorded region assuming that the image is recorded with the recording resolution, the reference line being defined by ink droplets forming the edge of the straight line portion assuming that the image is recorded with a higher resolution than the recording resolution stored in the memory; and in response to determining that the at least part of the predicted landing region is located outside the reference line, control the head and the carriage to adjust ejection timing of the ink droplet forming the edge of the straight line portion such that a protruding area of an actual landing region of the ink droplet is smaller than a protruding area of the predicted landing region, the protruding area being an area located outside the reference line.

According to another aspect, this specification also discloses a non-transitory computer-readable storage medium storing a set of program instructions for a computer of an electronic device that controls an inkjet recording apparatus. The set of program instructions, when executed by the computer, causing the electronic device to: extract an image resolution in a first direction of image data stored in a memory of the electronic device, the inkjet recording apparatus including a head having a plurality of nozzles for ejecting ink droplets onto a recording medium and a movement mechanism configured to cause at least one of the head and the recording medium to move in the first direction such that the head moves relative to the recording medium; determine, based on the image data, whether a straight line portion is included in a boundary between a recorded region and a non-recorded region of an image to be recorded on the recording medium; in response to determining that the straight line portion is included, determine whether the first direction is perpendicular to an extending direction of the straight line portion; determine whether a recording resolution in the first direction is lower than the extracted image resolution, the recording resolution being stored in the memory; in response to determining that the first direction is perpendicular to the extending direction and that the recording resolution is lower than the extracted image resolution, determine whether at least part of a predicted landing region is located outside a reference line, the predicted landing region being a landing region on the recording medium of an ink droplet forming an edge of the straight line portion of the recorded region assuming that the image is recorded with the recording resolution, the reference line being defined by ink droplets forming the edge of the straight line portion assuming that the image is recorded with a higher resolution than the recording resolution stored in the memory; and in response to determining that the at least part of the predicted landing region is located outside the reference line, control the head and the carriage to adjust ejection timing of the ink droplet forming the edge of the straight line portion such that a protruding area of an actual landing region of the ink droplet is smaller than a protruding area of the predicted landing region, the protruding area being an area located outside the reference line.

According to still another aspect, this specification also discloses an inkjet recording apparatus. The inkjet recording apparatus includes a head, a conveyor, a memory, and a controller. The head is configured to eject ink onto a recording medium. The head extends in a width direction of the recording medium. The conveyor is configured to convey the recording medium in a conveyance direction perpendicular to the width direction. The controller is configured to: extract an image resolution in the conveyance direction of image data stored in the memory; determine, based on the image data, whether a straight line portion is included in a boundary between a recorded region and a non-recorded region of an image to be recorded on the recording medium; in response to determining that the straight line portion is included, determine whether the conveyance direction is perpendicular to an extending direction of the straight line portion; determine whether a recording resolution in the conveyance direction is lower than the extracted image resolution, the recording resolution being stored in the memory; in response to determining that the conveyance direction is perpendicular to the extending direction and that the recording resolution is lower than the extracted image resolution, determine whether at least part of a predicted landing region is located outside a reference line, the predicted landing region being a landing region on the recording medium of an ink droplet forming an edge of the straight line portion of the recorded region assuming that the image is recorded with the recording resolution, the reference line being defined by ink droplets forming the edge of the straight line portion assuming that the image is recorded with a higher resolution than the recording resolution stored in the memory; and in response to determining that the at least part of the predicted landing region is located outside the reference line, control the head to adjust ejection timing of the ink droplet forming the edge of the straight line portion such that a protruding area of an actual landing region of the ink droplet is smaller than a protruding area of the predicted landing region, the protruding area being an area located outside the reference line.

BRIEF DESCRIPTION OF THE DRAWINGS

Embodiments in accordance with this disclosure will be described in detail with reference to the following figures wherein.

DETAILED DESCRIPTION

There is a case that the recording resolution of the image actually recorded by a printer on a recording medium is lower than the image resolution of an original image data created and stored by a PC (personal computer) or stored in the memory of the printer. The inventor of this disclosure found that, in this case, a dot row forming an edge of a bar (recorded region) extending in the direction (second direction) perpendicular to the direction (first direction) having a recording resolution lower than the image resolution is sometimes formed to protrude outside the position where the dot row should be. If the dot row forming the edge of the bar is formed outside the position where it should be, the width ratio of the bar and the space of the bar code image in the recorded image is out of the reference range, and a reading error may occur. Further, when a straight line such as a ruled line is recorded other than the code image, deterioration of the image quality may occur.

In view of the foregoing, an example of an object of the present disclosure is to provide an inkjet recording apparatus that secures the recording quality of straight line portions in the recorded region of an image and a storage medium storing program.

A printer as an inkjet recording apparatus of an embodiment of this disclosure will be described while referring to the accompanying drawings.

[Overall Configuration of Printer]

Figure 1:
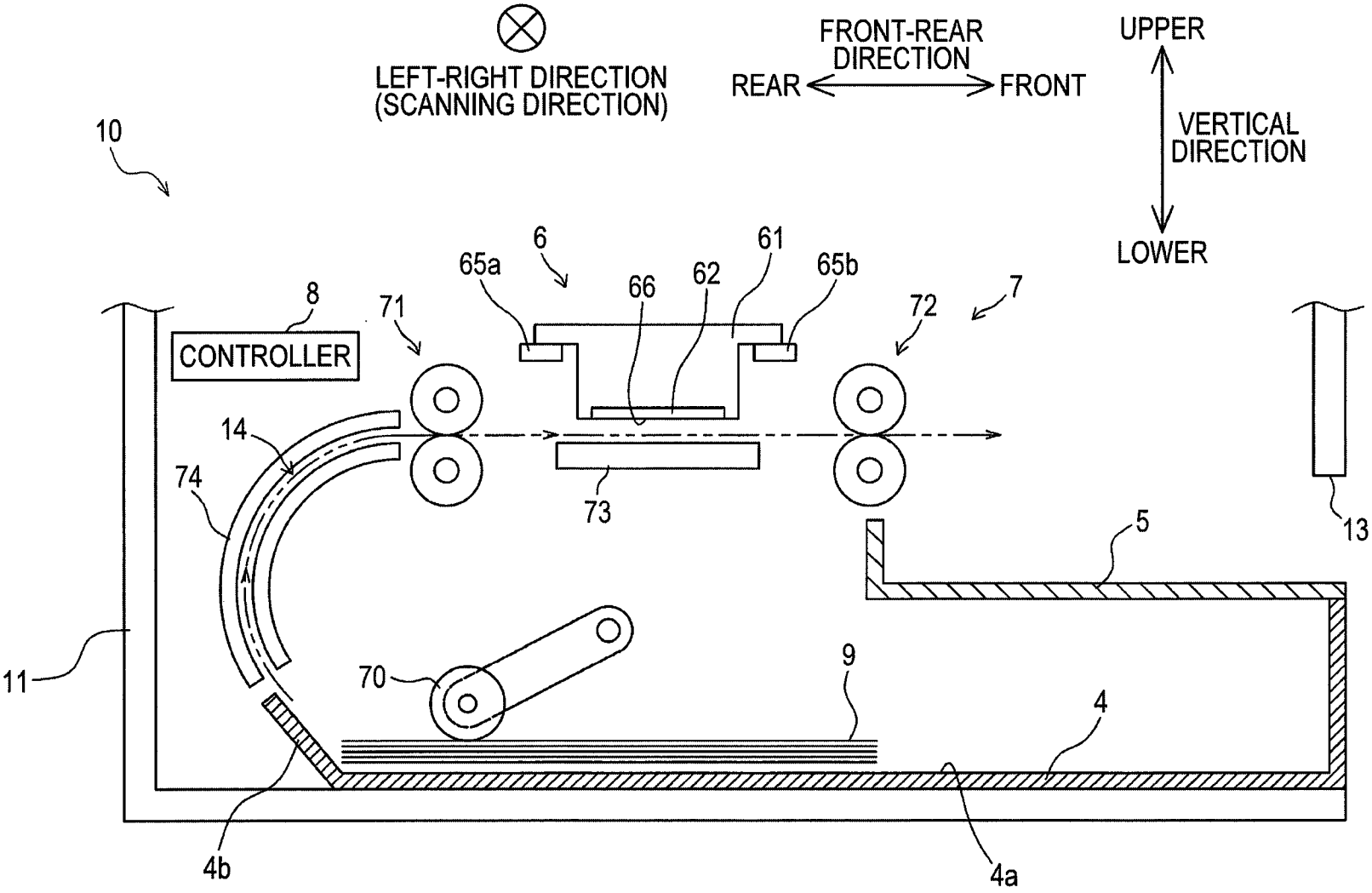
FIG. 1 is a schematic side view showing the internal structure of a printer according to an embodiment of this disclosure.

First, a printer 10 according to the present embodiment will be described. As shown in FIG. 1, the printer 10 includes a paper feed tray 4, a paper discharge tray 5, a printing unit (head moving unit) 6, a conveyance unit 7, and a controller 8. In the following description, a vertical direction is defined based on the state where the printer 10 is installed in a usable state (state of FIG. 1). A front-rear direction is defined assuming that the side where the opening 13 of the housing 11 is provided is the near side (front side). Further, a left-right direction is defined when viewed from the near side (front side) of the printer 10. The paper feed tray 4, the printing unit 6, the conveyance unit 7, and the controller 8 are housed in the housing 11 of the printer 10. The paper feed tray 4 is arranged below the printing unit 6 in the housing 11.

The paper feed tray 4 is configured to support and accommodate a plurality of papers of paper 9 in a stacked state. The paper feed tray 4 is configured to be inserted into and removed from the housing 11 in the front-rear direction. The paper feed tray 4 has a support surface 4 that supports the paper 9. An inclined plate 4*b* is provided at the rear end of the paper feed tray 4.

The paper discharge tray 5 accommodates the paper 9 on which an image is recorded by a head 62 of the printing unit 6 described later. The paper discharge tray 5 is arranged above the front side of the paper feed tray 4, and is configured to move as the paper feed tray 4 is inserted into and removed from the housing 11.

The printing unit 6 includes a carriage 61 and the head 62. The carriage 61 is supported by two guide rails 65*a* and 65*b*. The two guide rails 65*a* and 65*b* are arranged to be separated from each other in the front-rear direction, and each of the guide rails 65*a* and 65*b* extends in the left-right direction. The carriage 61 is arranged to straddle the two guide rails 65*a* and 65*b*. The carriage 61 is driven by a carriage motor 31 (see FIG. 3) so as to reciprocate along the two guide rails 65*a* and 65*b* in the left-right direction which is the scanning direction.

Figure 2:
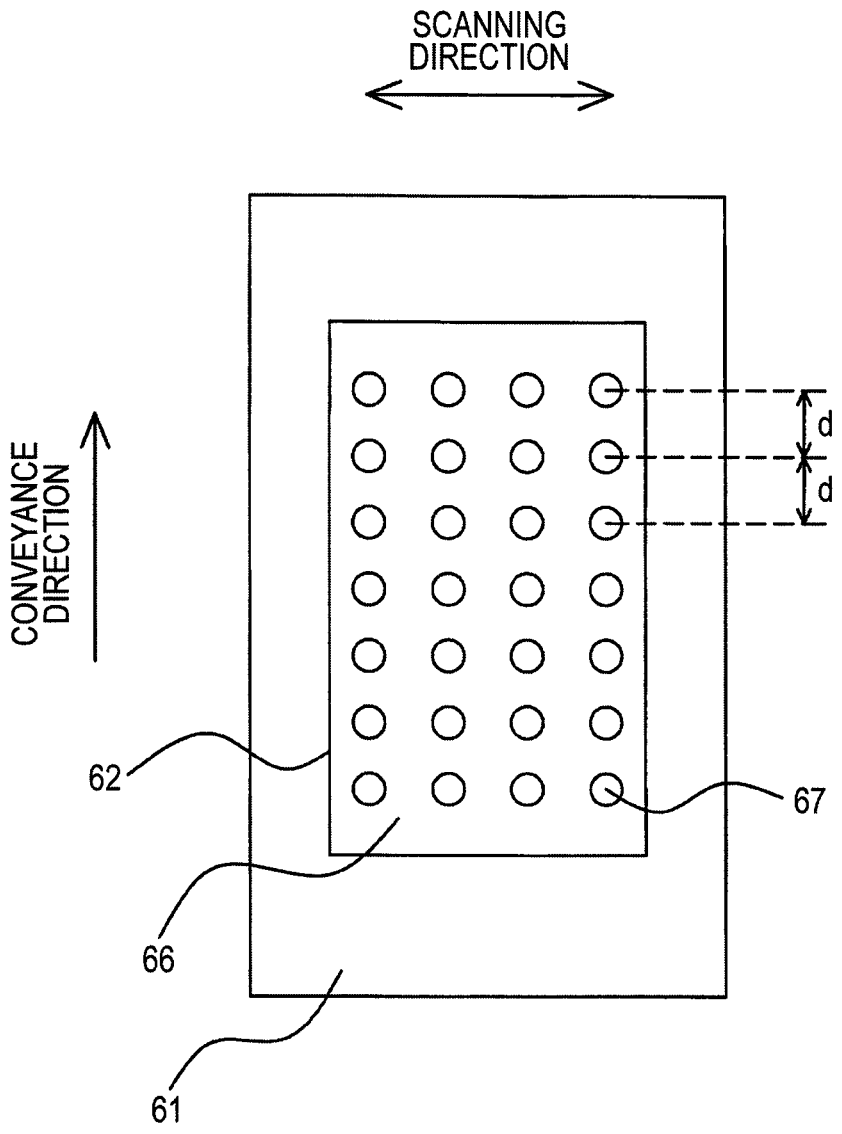
FIG. 2 is a bottom view of a head and a carriage included in the printer shown in FIG. 1.

The head 62 is mounted on the carriage 61 and reciprocates in the scanning direction together with the carriage 61. As shown in FIG. 2, a plurality of nozzles 67 for ejecting ink are arranged on the nozzle surface 66 on the lower surface of the head 62 at equal intervals along the conveyance direction (the front-rear direction) perpendicular to the scanning direction. That is, the distances between the two nozzles 67 adjacent to each other in the conveyance direction are all "d". The nozzles 67 are arranged on the nozzle surface 66 in four rows, the four rows being arranged in the scanning direction. The head 62 ejects ink supplied from four ink cartridges (not shown) that store ink of four colors (black, cyan, magenta, and yellow) from each row of the nozzles 67, thereby recording an image on paper 9. That is, the printer 10 in this embodiment is an inkjet serial printer capable of recording a color image.

The conveyance unit 7 conveys the paper 9 inside the printer 10, and includes a paper feed roller 70, a pair of conveyance rollers 71, a pair of discharge rollers 72, a platen 73, and a guide member 74. The paper feed roller 70 is disposed above the paper feed tray 4, and is rotated by being applied with a driving force from a paper feed motor 32 (see FIG. 3), thereby sending the paper 9 accommodated in the paper feed tray 4 rearward. The pair of conveyance rollers 71 and the pair of discharging rollers 72 are arranged to sandwich the printing unit 6 in the front-rear direction. The pair of conveyance rollers 71 is arranged at the rear of the printing unit 6, and the pair of discharge rollers 72 is arranged at the front of the printing unit 6. The pair of conveyance rollers 71 sends the paper 9 to a region facing the nozzle surface 66 of the head 62. The pair of discharge rollers 72 receives the paper 9 sent by the pair of conveyance rollers 71, and discharges the paper 9 to the paper discharge tray 5. The pair of conveyance rollers 71 and the pair of discharge rollers 72 are driven to rotate by a conveyance motor 33 (see FIG. 3).

The platen 73 is arranged below the printing unit 6 so as to face the nozzle surface 66 of the printing unit 6. The guide member 74 defines a conveyance path 14 for sending the paper 9 sent out from the paper feed tray 4 by the paper feed roller 70 to a region facing the nozzle surface 66 of the head 62. The guide member 74 extends from a position near the rear end of the paper feed tray 4 to a position near the pair of conveyance rollers 71.

The paper 9 fed rearward from the paper feed tray 4 by the paper feed roller 70 is directed obliquely upward by the inclined plate 4*b* provided at the rear end of the paper feed tray 4, passes through the conveyance path 14 defined by the guide member 74, and reaches a position where the paper 9 is nipped by the pair of conveyance rollers 71. The paper 9 nipped by the pair of conveyance rollers 71 is conveyed to the region facing the nozzle surface 66 of the head 62 by the rotation of the pair of conveyance rollers 71. In a state where the paper 9 conveyed by the pair of conveyance rollers 71 is supported by the platen 73, ink is ejected from nozzles 67 provided on the nozzle surface 66 of the head 62 that moves in the scanning direction so that an image is recorded on the paper 9. The paper 9 on which the image is recorded is conveyed forward by the pair of discharge rollers 72 and is discharged onto the discharge tray 5.

[Controller]

Figure 3:
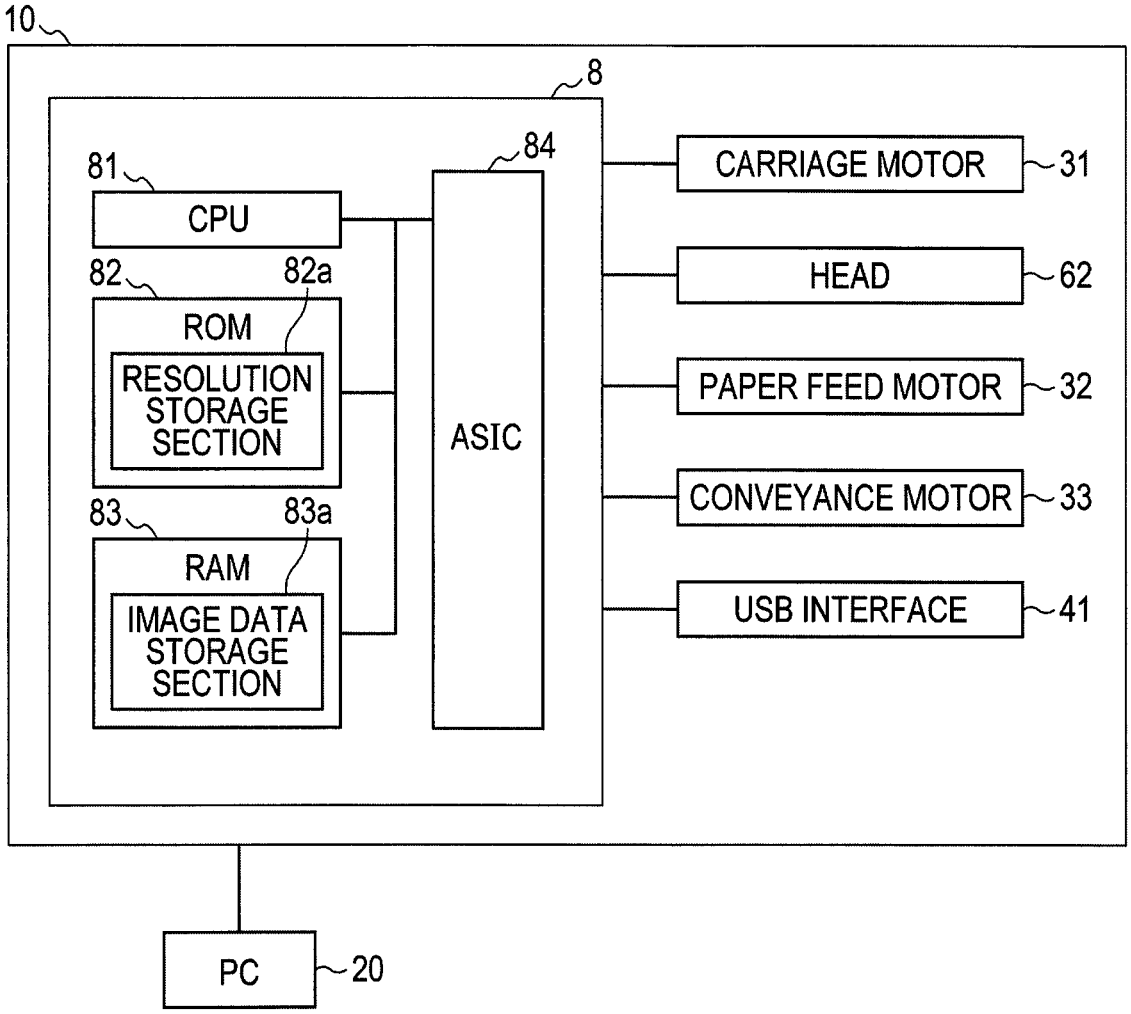
FIG. 3 is a block diagram schematically showing the electrical configuration of the printer shown in FIG. 1 and a PC connected to the printer.

The controller 8 controls the entire printer 10, and as shown in FIG. 3, the carriage motor 31, the head 62, the paper feed motor 32, the conveyance motor 33, and so on are electrically connected. Further, a USB interface 41 is electrically connected to the controller 8. The USB interface 41 is a USB standard interface and can be connected to a USB memory as a removable memory. In addition, a PC (Personal Computer) 20 that is an external device is connected to the controller 8 of the printer 10. The printer 10 and the PC 20 may be connected through a LAN (Local Area Network), or may be connected not through the LAN. Further, the data transmission/reception between the printer 10 and the PC 20 may be performed by wireless communication or wired communication. It is also possible to wirelessly connect a portable terminal such as a smartphone to the printer 10 through a LAN or directly.

The controller 8 includes a CPU (Central Processing Unit) 81, a ROM (Read Only Memory) 82, a RAM (Random Access Memory) 83, an ASIC (Applicant Specific Integrated Circuit) 84, and so on. At least part of the ROM 82 is an electrically erasable and rewritable EEPROM (Electrically Erasable Programmable Read-Only Memory). The ROM 82 stores programs executed by the CPU 81 and the ASIC 84, various fixed data, and so on. Further, the ROM 82 includes a resolution storage section 82*a* that preliminarily stores information on a plurality of recording resolutions, that is, printing resolutions (for example, 300 dpi, 600 dpi, 1200 dpi, 2400 dpi, and so on) in each of the conveyance direction and the scanning direction recorded by the printer 10. In an initial state, one of the plurality of recording resolutions for each of the conveyance direction and the scanning direction is set as the default recording resolution that is to be used during recording. The RAM 83 includes an image data storage section 83*a* that temporarily stores image data and so on necessary for executing the programs. The PC 20 has a CPU, a ROM, a RAM, and an HDD (Hard Disk Drive), which are not shown. An OS (Operation System) and a printer driver are installed in the HDD. The CPU controls the operation of the printer 10 by executing the printer driver. The printer driver may be also installed in the ROM of the mobile terminal.

When image data is inputted from a USB memory connected to the USB interface 41 or from the PC 20, the controller 8 causes the CPU 81 and the ASIC 84 to execute recording processing based on the program stored in the ROM 82 and on the image data temporarily stored in the RAM 83. With this operation, an image relating to the image data is recorded on the paper 9. In the recording processing, the controller 8 controls driving of the carriage motor 31 and the head 62 so as to perform a pass recording operation of ejecting ink from the nozzles 67 of the head 62 while moving the carriage 61 in the scanning direction based on the recording resolution stored in the ROM 82 and on the image data stored in the RAM 83. Further, the controller 8 controls driving of the conveyance motor 33 such that, after the pass recording operation is performed twice, the conveyance unit 7 conveys the paper 9 by a particular distance in the conveyance direction. In the printer 10 according to this embodiment, in order to record the image 50 relating to inputted image data on the paper 9, the pass recording operation by the printing unit 6 and the conveyance operation of the paper 9 by the conveyance unit 7 are repeatedly executed.

[Ink Dots Forming Bars]

Figure 4A:
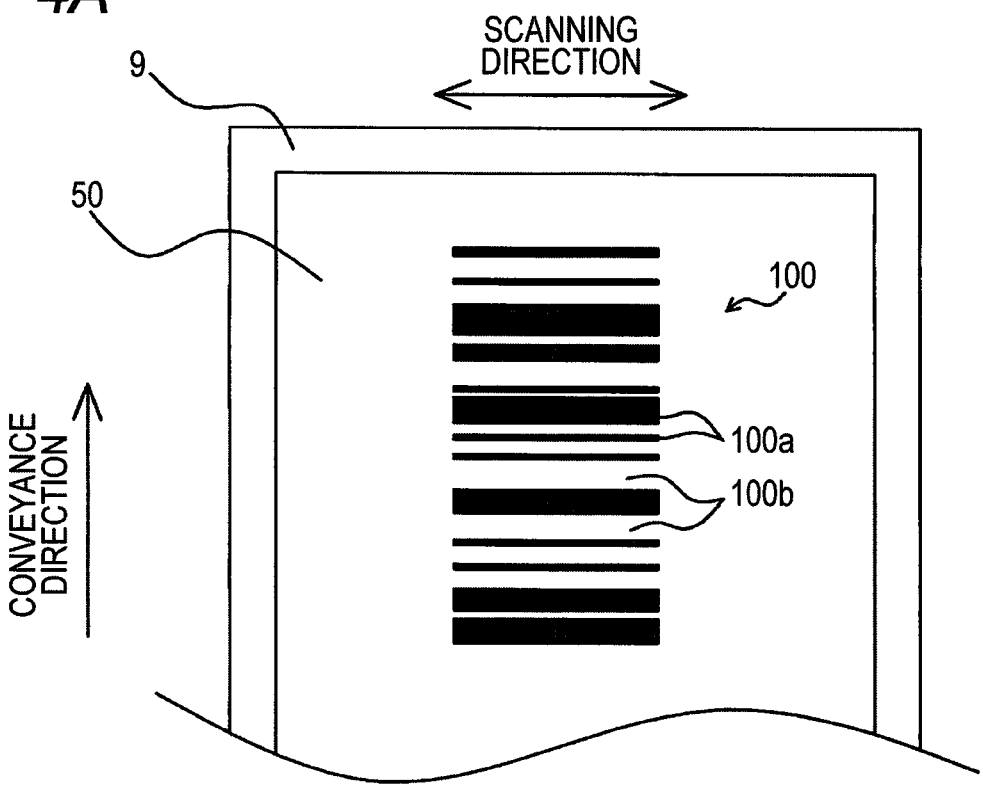
FIG. 4A is a diagram showing a state where a one-dimensional code image is arranged such that the longitudinal direction of the one-dimensional code image is parallel to the conveyance direction.
Figure 4B:
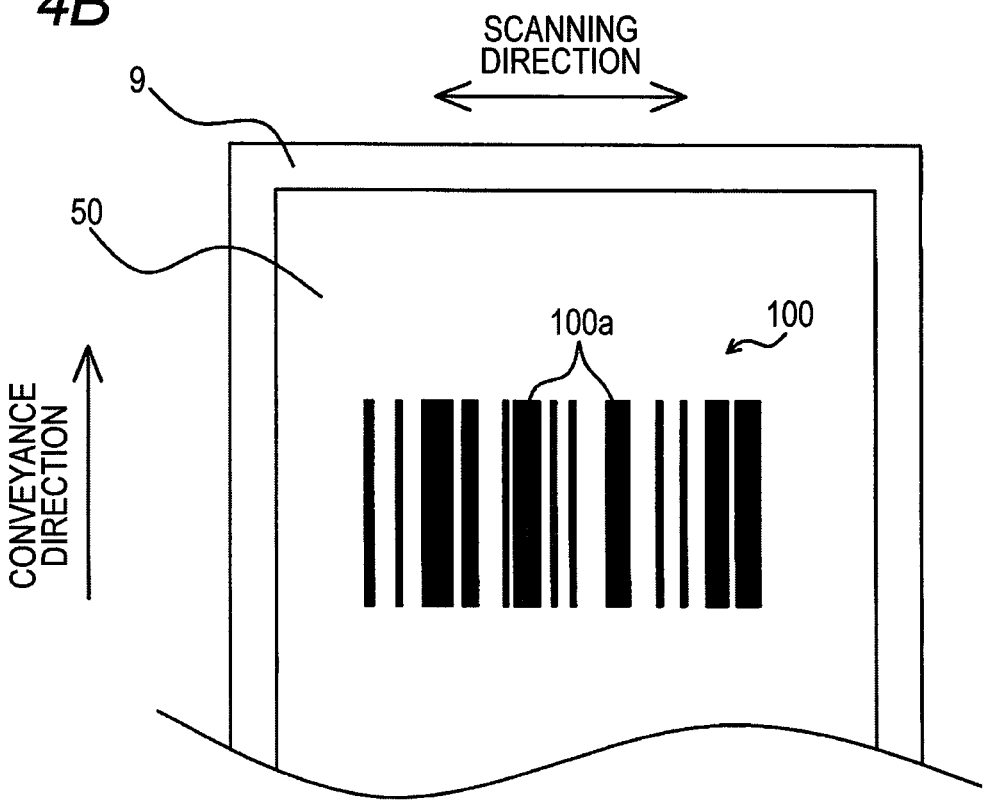
FIG. 4B is a diagram showing a state where a one-dimensional code image is arranged such that the longitudinal direction of the one-dimensional code image is perpendicular to the conveyance direction.

Image data which is the target of the present embodiment will be described. As shown in FIGS. 4A and 4B, the present embodiment is directed to image data relating to an image 50 including a one-dimensional code image 100 formed with a plurality of recorded regions (bars) 100*a* and a plurality of non-recorded regions 100*b*. Regarding the one-dimensional code image 100, there is a case where, as shown in FIG. 4A, the one-dimensional code image 100 is recorded in such an orientation that the facing direction (arrangement direction) in which adjacent recorded regions 100*a* face each other is the same as (parallel to) the conveyance direction, and there is a case where, as shown in FIG. 4B, the one-dimensional code image 100 is recorded in such an orientation that the facing direction in which adjacent recorded regions 100*a* face each other is the same as (parallel to) the scanning direction. In FIG. 4A, the one-dimensional code image 100 is arranged such that the longitudinal direction of the one-dimensional code image 100 is parallel to the conveyance direction of the paper 9, whereas in FIG. 4B, the one-dimensional code image 100 is arranged such that the longitudinal direction of the one-dimensional code image 100 is perpendicular to the conveyance direction of the paper 9. The widths of the individual recorded regions 100*a* and the individual non-recorded regions 100*b* in the one-dimensional code image 100 differ according to the information that needs to be displayed in the one-dimensional code image 100. In the present embodiment, the one-dimensional code image 100 is a barcode.

A case will be described below where, as shown in FIG. 4B, the facing direction of the one-dimensional code image 100 is the same as the scanning direction and where, in addition thereto, among the resolutions stored in the resolution storage section 82*a*, the recording resolution in the scanning direction that is used at the time of recording is lower than the image resolution of the image data in the scanning direction that is stored in the image data storage section 83*a*.

Figure 5A:
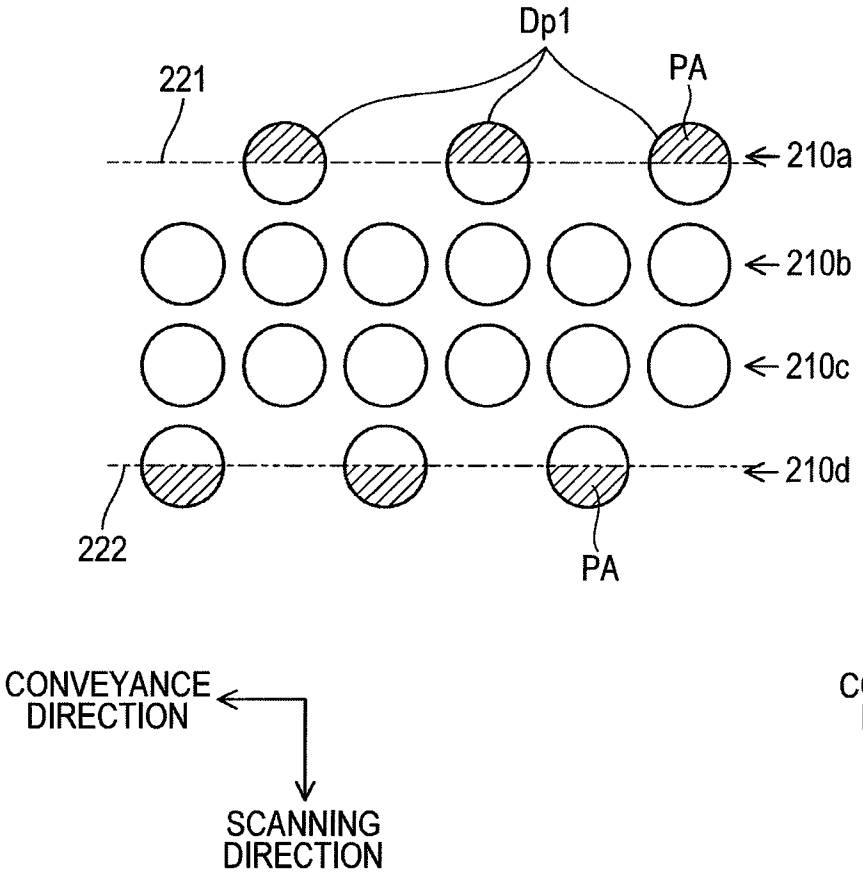
FIG. 5A is a partial schematic view showing actual landing positions on paper by a plurality of ink droplets forming one bar in a comparative example.

In such a case, FIG. 5A is a partial schematic diagram which indicates, in a printer of a comparative example, actual landing positions on the paper by a plurality of ink droplets forming one bar included in a one-dimensional code image drawn on paper. In this example, it is assumed that the image resolutions of the image data stored in the image data storage section 83*a* in both the scanning direction and the conveyance direction are 1200 dpi, and that the recording resolutions in both the scanning direction and the conveyance direction are 300 dpi.

In FIG. 5A, each circle ("○") indicates a landing position (landing region) on the paper 9 by an ink droplet ejected from the head 62. The region within each circle indicating an ink dot is referred to as "landing region". The size of the circle, that is, the diameter thereof, indicates the approximate size of an ink dot on the paper 9 that is formed as a result of landing of the ink droplet. Hence, the following description may be given with the assumption that the circle is the ink dot that is formed on the paper. In this example, one bar is formed with four dot rows 210*a*, 210*b*, 210*c*, and 210*d* that extend in the conveyance direction. The distance in the conveyance direction between the dots of the dot rows 210*a* and 210*d* on both left and right sides forming the edges of the bar is twice as long as the distance in the conveyance direction between the dots of the dot rows 210*b* and 210*c* forming the portions other than the edges. How many times the distance in the conveyance direction between the dots of the dot rows forming the edges is as long as the distance in the conveyance direction between the dots of the dot rows forming the portions other than the edges is changed depending on a ratio between the image resolution and the recording resolution in the scanning direction.

With respect to the ink dots within the dot rows 210*a* and 210*d* forming the edges of the bar, half of each dot is located outside reference lines 221 and 222 drawn by the double-dot chain lines indicating reference landing positions and extending in the conveyance direction. In the present embodiment, the reference landing positions refer to landing positions on the paper 9 by the ink droplets forming the edges of the bar when it is assumed that the one-dimensional code image 100 is recorded with the same recording resolution as the image resolution (1200 dpi) of the image data in the scanning direction.

Figure 7:
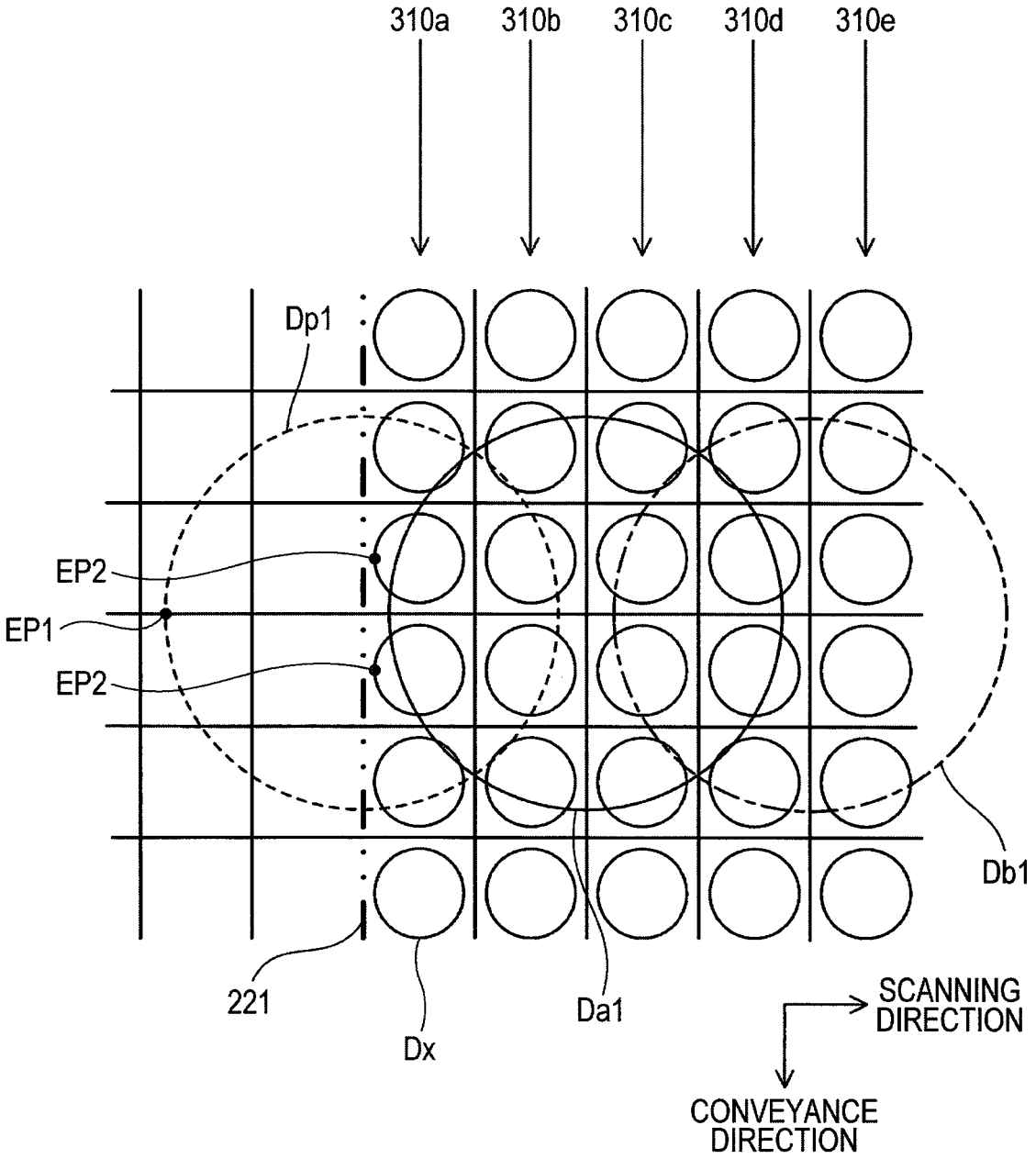
FIG. 7 is a schematic enlarged view showing a vicinity of an ink dot Dp1 forming an edge depicted in FIG. 5A.

The reference landing positions will be described in more detail with reference to FIG. 7. FIG. 7 is a schematic enlarged view of the vicinity of an ink dot Dp1 belonging to the dot row 210*a* shown in FIG. 5A. FIG. 7 schematically shows the landing positions (landing regions) on paper by a plurality of ink droplets forming the vicinity of the edge of one bar included in the one-dimensional code image when it is assumed that the one-dimensional code image is recorded with the recording resolutions of 1200 dpi in both the scanning direction and the conveyance direction. In FIG. 7, smaller circles are the landing positions of the ink droplets formed with 1200 dpi, and the size thereof, that is, the diameter thereof, indicates the approximate size of the ink dot on the paper 9 that is formed as a result of landing of the ink droplet.

In FIG. 7, five dot rows 310*a*, 310*b*, 310*c*, 310*d*, and 310*e* extending in the conveyance direction are shown. The leftmost dot row 310*a* forms a left side edge when the recording resolution of the bar in the scanning direction is set to 1200 dpi. The line that extends in the conveyance direction on the left side of the dot row 310*a* is the reference line 221 shown in FIG. 5A. The reference line 221 is a straight line that is adjacent to or in contact with the outside (or periphery) of all the ink dots (that is, outer end points EP2 of ink dots in the scanning direction, see FIG. 7) belonging to the dot row 310*a* and extends in the conveyance direction. More specifically, when it is assumed that the ink dots belonging to the dot row 310*a* are circular, the distance from the center thereof to the reference line 221 is half the distance between the center of an ink dot belonging to the dot row 310*a* and the center of an ink dot belonging to the dot row 310*b*, which are located in the same positions in the conveyance direction. The position of the reference line 222 is likewise determined on the right side of the bar. Hence, in the present embodiment, the lines 221 and 222 indicate the outer edges of the reference landing positions of the ink droplets forming the edges of the bar.

Since in the comparative example as described above, as shown in FIGS. 5A and 7, half of each dot belonging to the dot rows 210*a* and 210*d* forming the edges of the bar is located outside the reference lines 221 and 222, the thickness of the bar is recognized to be greater than the original (correct) thickness of the bar (the thickness of the bar recorded with the same resolution as the image resolution, that is, the distance between the reference lines 221 and 222), and a reading error may occur. In FIG. 5A, the area of each dot of the dot rows 210*a* and 210*d* located outside the reference line 221, 222 (referred to as "protruding area PA") is shown by hatching.

First Recording Example

In a first recording example of the present embodiment, when at least part of the predicted landing positions (predicted landing regions) of the ink droplets forming the left and right edges of the recorded regions 100*a* are located outside the lines 221 and 222, the ejection timing of the ink droplets is adjusted, such that the dots belonging to the dot rows 210*a* and 210*d* are located inside the lines 221 and 222.

Figure 5B:
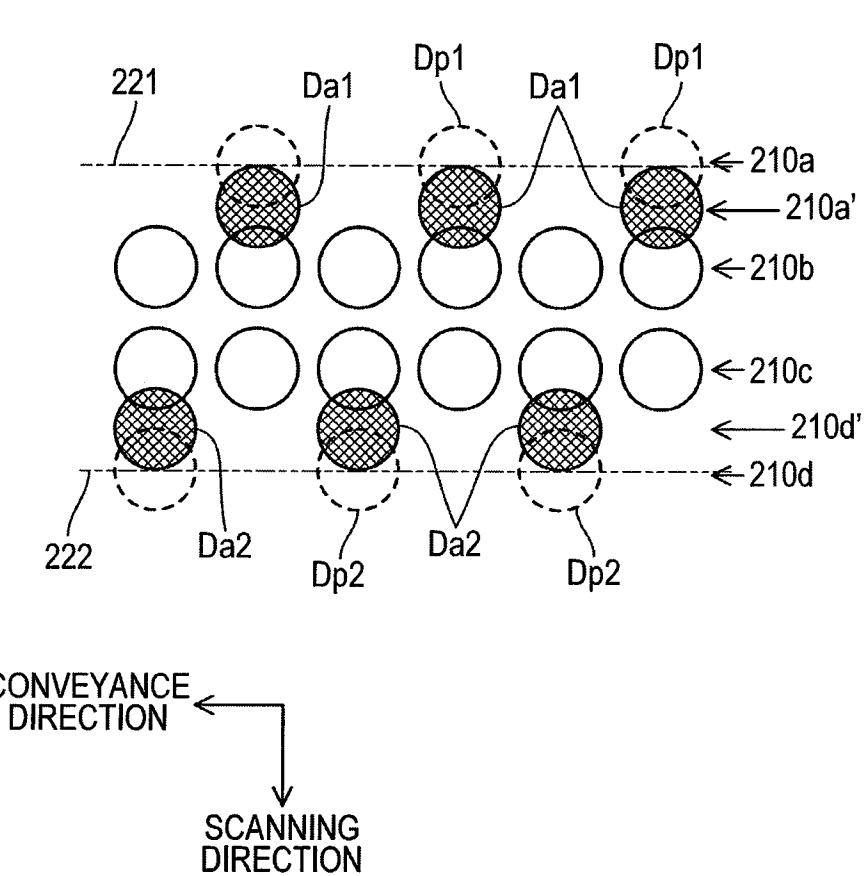
FIG. 5B is a partial schematic view showing predicted landing positions and actual landing positions in a first recording example according to the embodiment.

A more detailed description will be given based on FIGS. 5B and 7. In FIG. 5B, the circles surrounded by solid lines indicate the landing positions of the ink droplets formed on the paper 9 in the first recording example. In the first recording example, the landing positions of the ink droplets forming the dots belonging to the dot rows 210*b* and 210*c* are the same as those drawn in FIG. 5A. On the other hand, by the ejection timing adjustment, the dot rows 210*a* and 210*d* forming the edges of the bar are moved inward so as to form dot rows 210*a*' and 210*d*'. In FIG. 5B, the predicted landing positions, which are the landing positions before the ejection timing adjustment, are indicated by the broken lines, and the actual (adjusted) landing positions after the ejection timing adjustment are cross-hatched (45 degrees) and surrounded by the solid lines.

As is understood from FIG. 7, in the first recording example, by the ejection timing adjustment, the ink dot Dp1 belonging to the dot row 210*a* is moved rightward by a distance corresponding to two dots at 1200 dpi. In this way, instead of the ink dot Dp1, an ink dot Da1 is formed. The amount of ejection timing adjustment (time) is calculated by dividing the distance corresponding to two dots at 1200 dpi by a carriage movement speed. Likewise, the ink dot Dp2 belonging to the dot row 210*d* is moved leftward by the distance corresponding to two dots at 1200 dpi, and thus instead of the ink dot Dp2, an ink dot Da2 is formed. As in the first recording example, the ink dots forming the edges are located inside the reference landing positions, and thus the thickness of the recorded region is close to the original thickness, and thus a reading error becomes less likely to occur. That is, the ejection timing is adjusted such that the protruding area, located outside the reference line 221, 222, of the actual landing region (ink dots Da1, Da2) is smaller than the protruding area of the predicted landing region (ink dots Dp1, Dp2). The ejection timing of only some ink dots within the bar is adjusted, and the recording resolution in the scanning direction (first direction) is not increased, which prevents the recording speed from decreasing. The landing positions of the ink droplets forming the edges when the bar is recorded with the image resolution of 1200 dpi are set as the reference landing positions, and thus the recording quality of the bars is further improved.

In a modification of the first recording example, by the ejection timing adjustment, the ink dot Dp1 belonging to the dot row 210*a* may be moved rightward by a distance corresponding to four dots at 1200 dpi, and the ink dot Dp2 belonging to the dot row 210*d* may be moved leftward by the distance corresponding to four dots at 1200 dpi. In this way, as shown in FIG. 7, instead of the ink dot Dp1, an ink dot Db1 (indicated by the single-dot chain line) is formed (the illustration of an ink dot Db2 is omitted). The amount of ejection timing adjustment is calculated by dividing the distance corresponding to four dots at 1200 dpi by the carriage movement speed.

In another modification of the first recording example, the position of the ink dot Dp1 belonging to the dot row 210*a* after the ejection timing adjustment may be in such a position as to be located rightward of the ink dot Dp1 and leftward of the ink dot Db1, and the position of the ink dot Dp2 belonging to the dot row 210*d* after the ejection timing adjustment may be in such a position as to be located leftward of the ink dot Dp2 and rightward of the ink dot Db2. In other words, the positions of the ink dots after the ejection timing adjustment are preferably moved toward inside the lines 221 and 222 as compared with the ink dots Dp1 and Dp2 before the ejection timing adjustment. Even in such a case, the amount of ejection timing adjustment is calculated by dividing the amount of movement of the ink dot by the carriage movement speed. The two modifications of the first recording example described above may also be applied to a second recording example and a third recording example, which will be described later.

Second Recording Example

Figure 6B:
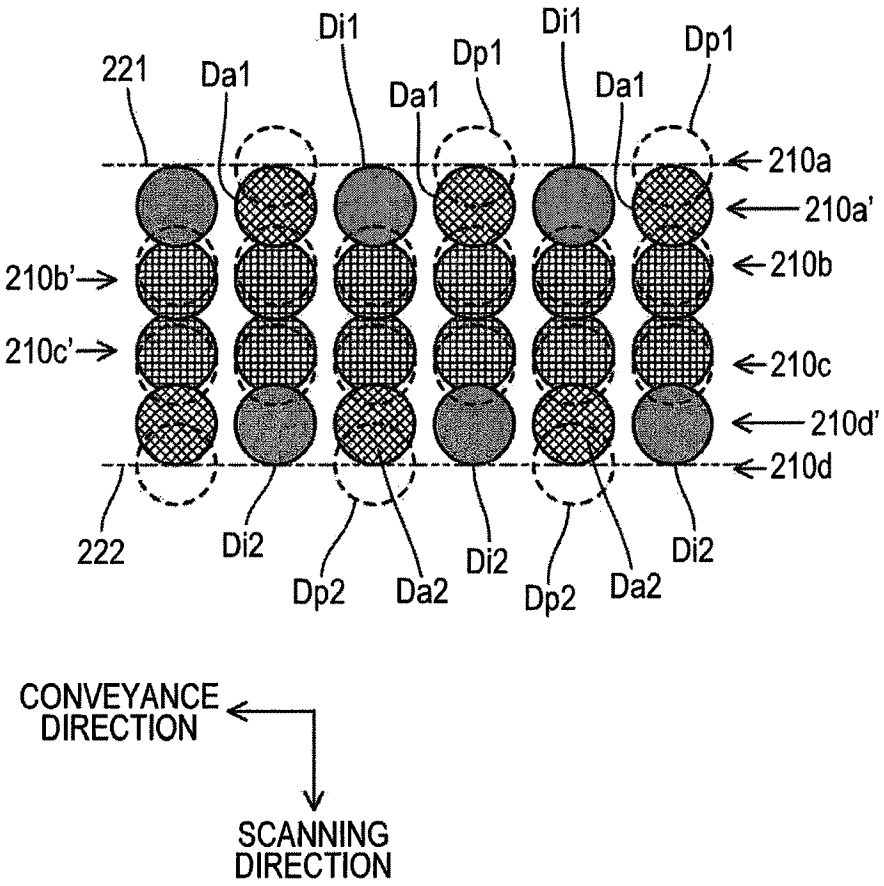
FIG. 6B is a partial schematic view showing predicted landing positions and actual landing positions in a third recording example according to the embodiment.
Figure 6A:
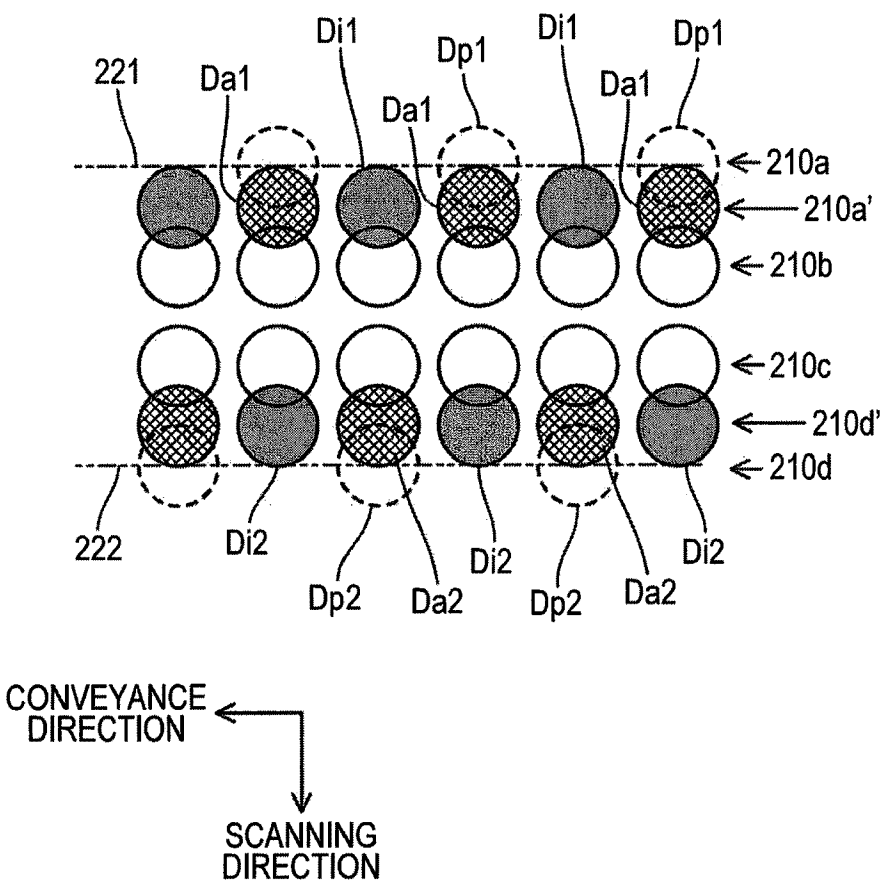
FIG. 6A is a partial schematic view showing predicted landing positions and actual landing positions in a second recording example according to the embodiment.

Next, the second recording example of the present embodiment will be described further with reference to FIG. 6A. In FIG. 6A, the circles surrounded by solid lines indicate landing positions of the ink droplets formed on the paper 9 in the second recording example. In the second recording example, the landing positions of the ink droplets forming the dots belonging to the dot rows 210*b* and 210*c* are the same as those drawn in FIG. 5A. The second recording example is the same as the first recording example in that the ink dots Da1 and Da2 belonging to the dot rows 210*a*' and 210*d*' are formed instead of the ink dots Dp1 and Dp2 belonging to the dot rows 210*a* and 210*d*. Further, in the second recording example, the image data is changed such that the number of ink dots forming the edges of the bar and belonging to the dot rows 210*a*' and 210*d*' is doubled. Specifically, in each intermediate point between two adjacent ink dots Da1 in the conveyance direction, an ink dot Di1 is added, and in each intermediate point between two adjacent ink dots Da2 in the conveyance direction, an ink dot Di2 is added. In FIG. 6A, the landing positions of the ink dots Di1 and Di2 are gray areas surrounded by the solid lines. In this way, the distance (in the conveyance direction) between the ink dots belonging to the dot rows 210*a*' and 210*d*' is the same as the distance (in the conveyance direction) between the ink dots belonging to the dot rows 210*b* and 210*c*. As described above, the dot arrangement in the first recording example is adopted in the second recording example, and moreover, the ink dots Di1 and Di2 forming the edges of the bar are added. Thus, the distance in the conveyance direction between the dots within each dot row is the same in the edges and in the portions other than the edges. Hence, the recording quality of the bar is further improved, and thus a recoding error becomes less likely to occur.

Third Recording Example

Next, the third recording example of the present embodiment will be described further with reference to FIG. 6B. In FIG. 6B, the circles surrounded by the solid lines indicate the landing positions of the ink droplets formed on the paper 9 in the third recording example. In the third recording example, the landing positions of the ink droplets forming the dots belonging to the dot rows 210*a*' and 210*d*' are the same as those drawn in FIG. 6A. On the other hand, by the ejection timing adjustment, the ink dots belonging to the dot row 210*b* are moved rightward, and the ink dots belonging to the dot row 210*c* are moved leftward, thereby dot rows 210*b*' and 210*c*' are formed. In FIG. 6B, the landing positions of the ink dots belonging to the dot rows 210*b*' and 210*c*' are cross-hatched (90 degrees) and surrounded by the solid lines. In this way, the landing positions of the ink droplets belonging to the four dot rows 210*a*', 210*b*', 210*c*', and 210*d*' are located at equal intervals in the scanning direction. Hence, the recording quality of the bar is further improved, and thus a reading error becomes less likely to occur.

[Printer Operation Based on Third Recording Example]

Figure 8:
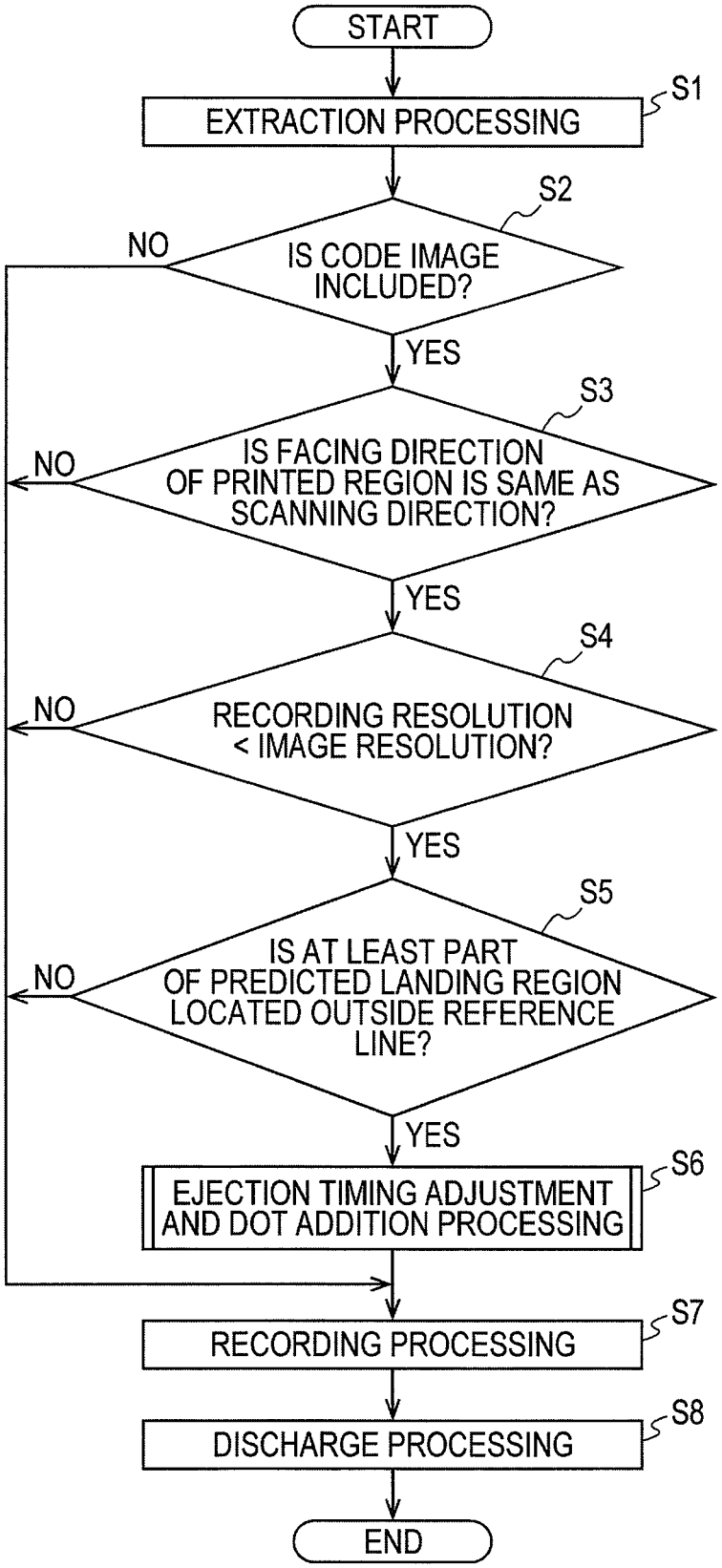
FIG. 8 is a flowchart showing the operations of the printer shown in FIG. 1.

Next, the operation of the printer 10 according to the present embodiment when the printer 10 records the image 50 on paper 9 will be described with reference to the flowchart of FIG. 8. Here, a description will be provided based on the third recording example shown in FIG. 6B.

First, a recording command relating to the image data is supplied to the printer 10 based on the operation of an operation interface (not shown) of the printer 10 or the operation of the PC 20 by a user. The image data is supplied from a USB memory or the PC 20 to the printer 10 accordingly and is temporarily stored in the RAM 83. For each of the conveyance direction and the scanning direction, one recording resolution included in the recording command may be set as the recording resolution to be used, instead of a default value. In step S1 ("step" will be hereinafter abbreviated as "S"), the controller 8 executes extraction processing of extracting the image resolution in the scanning direction relating to the image data stored in the RAM 83. The extraction processing may include, for example, referring to header information in an image file. Then, in S2, the controller 8 executes first determination processing of determining, based on the image data, whether the one-dimensional code image 100 is included in the image 50 to be recorded on the paper 9.

In response to determining that the one-dimensional code image 100 is not included in the image 50 to be recorded on the paper 9 (S2: NO), in S7, the controller 8 executes recording processing of recording the image 50 relating to the image data on the paper 9 by repeatedly performing a pass recording operation using the printing unit 6 and an operation of conveying the paper 9 with the conveyance unit 7, based on the recording resolution to be used for recording for each of the conveyance direction and the scanning direction and that is previously stored in the ROM 82. In response to determining that the one-dimensional code image 100 is included in the image 50 to be recorded on the paper 9 (S2: YES), in S3, the controller 8 executes second determination processing of determining in which one of the orientations shown in FIGS. 4A and 4B the one-dimensional code image 100 on the paper 9 is to be recorded, and specifically determines whether the facing direction in which adjacent recorded regions 100*a* in the one-dimensional code image 100 face each other is the same as the scanning direction. In response to determining that the facing direction is not the same as the scanning direction (S3: NO), the controller 8 executes the recording processing described above (S7).

In response to determining that the facing direction in which adjacent recorded regions 100*a* face each other is the same as the scanning direction (S3: YES), in S4, the controller 8 executes third determination processing of determining whether the recording resolution in the scanning direction previously stored in the ROM 82 is lower than the image resolution in the scanning direction extracted in the extraction processing (S1). When the recording resolution in the scanning direction is higher than or equal to the image resolution in the scanning direction (S4: NO), the controller 8 executes the recording processing described above (S7).

In response to determining that the recording resolution in the scanning direction is lower than the image resolution in the scanning direction (S4: YES), in S5, the controller 8 derives the predicted landing positions and the reference landing positions. The predicted landing positions are landing positions of the ink droplets forming the edges of the recorded region on the paper 9 when the one-dimensional code image 100 is recorded with the recording resolution in the scanning direction previously stored in the ROM 82. As described above, the reference landing positions are the lines 221 and 222 that are drawn in FIGS. 5A and 7 and are drawn as the double-dot chain lines that extend in the conveyance direction. And, the reference landing positions are the landing positions on the paper 9 by the ink droplets forming the edges of the bar when it is assumed that the one-dimensional code image 100 is recorded with the same recording resolution as the image resolution (1200 dpi) of the image data in the scanning direction. In S5, the controller 8 executes fourth determination processing of determining whether the predicted landing positions are located outside the reference landing positions. That is, the controller 8 determines whether an outer end point EP1 (the left end in FIG. 7) of ink dot Dp1 of the recording resolution (300 dpi) that land on the predicted landing position is located farther outward than outer end points EP2 (the left end) of imaginary ink dots Dx of the image resolution (1200 dpi) forming the edge of the straight line portion. In other words, the controller 8 determines whether at least part of predicted landing region (ink dots Dp1, Dp2) is located outside the reference line 221, 222. In response to determining that the predicted landing positions are not located outside the reference landing positions (S5: NO), the controller 8 executes the recording processing described above (S7).

In response to determining that the predicted landing positions are located outside the reference landing positions (S5: YES), in S6, the controller 8 executes ejection timing adjustment and dot addition processing, which has been described with reference to FIGS. 5B, 6A, and 6B.

The details of the ejection timing adjustment and the dot addition processing in S6 will be described with reference to FIG. 9. First, in S61, as described with reference to FIG. 5B, the controller 8 derives (calculates) an adjustment value for ejection timing such that the ink dots Dp1 and Dp2 forming the edges and whose predicted landing regions are partially located outside the lines 221 and 222 are changed into the ink dots Da1 and Da2 located inside the lines 221 and 222. Note that, as shown in FIG. 5B, a part (half) of the predicted landing region of each ink dot Dp1, Dp2 is located outside the lines 221 and 222, whereas the entirety of each ink dot Da1, Da2 is located inside the lines 221 and 222. Then, the controller 8 stores the ejection timing that is adjusted with the adjustment value or the adjustment value itself in the RAM 83.

In S62, as described with reference to FIG. 6A, the controller 9 corrects the image data such that the ink dot Di1 is added to each intermediate point between two adjacent ink dots Da1 in the conveyance direction, and that the ink dot Di2 is added to each intermediate point between two adjacent ink dots Da2 in the conveyance direction.

Finally, the controller 8 derives an adjustment value for ejection timing such that the ink dots belonging to the dot row 210*b* are moved rightward so as to form the dot row 210*b*', the ink dots belonging to the dot row 210*c* are moved leftward so as to form the dot row 210*c*', and thus the landing positions of the ink droplets belonging to the four dot rows 210*a*', 210*b*', 210*c*', and 210*d*' are located at equal intervals in the scanning direction. Then, the controller 8 stores the ejection timing that is adjusted with the adjustment value or the adjustment value itself in the RAM 83.

With reference back to FIG. 8, in S7, as described above, the controller 8 executes the recording processing of recording the image 50 relating to the image data on the paper 9 by repeatedly performing the pass recording operation using the printing unit 6 and the operation of conveying the paper 9 with the conveyance unit 7. When the processing proceeds from S6 to S7 to execute the recording processing, the ink ejection is performed based on the image data corrected in S62 by using the adjusted ejection timing or the adjustment value obtained in S61 and S63.

After executing the recording processing (S7), in S8, the controller 8 executes discharge processing in which the paper 9 is discharged to the discharge tray 5 by the pair of discharge rollers 72. In this way, the printer 10 according to the present embodiment completes the operation of recording the image 50 on the paper 9.

As described above, in the present embodiment, when the one-dimensional code image 100 is included in the image 50 to be recorded on the paper 9, the recording quality of the bar is secured. Because the recording resolution of the entire image is not increased, the recording speed is not decreased. Further, because the recording resolution in the scanning direction (the first direction) is not increased, the recording speed is not decreased.

Modifications

While the disclosure has been described in detail with reference to the above aspects thereof, it would be apparent to those skilled in the art that various changes and modifications may be made therein without departing from the scope of the claims.

Although the first to third recording examples have been described with respect to the above-described embodiment, other dot arrangements may be adopted. For example, the four dot rows 210*a*', 210*b*', 210*c*', 210*d*' may be arranged at equal intervals in the scanning direction without adding the ink dots Di1, Di2. This corresponds to an arrangement in which the ink dots Di1, Di2 are omitted in FIG. 6B.

The reference landing positions may be the landing positions on a recording medium of ink droplets forming an edge of a straight line portion of the recorded region when an image is recorded with a resolution other than the image resolution (1200 dpi) of image data in the scanning direction, the resolution being a recording resolution higher than the recording resolution in the scanning direction that is stored in the resolution storage section 82*a*.

In the above-described embodiment, the entirety of each ink dot Da1, Da2 after adjusting ejection timing is located inside the lines 221 and 222. Alternatively, a part of each ink dot Da1, Da2 may be located outside the lines 221 and 222 as long as the area of the part of each ink dot Da1, Da2 located outside the lines 221 and 222 (the protruding area) is smaller than the area of the part of each ink dot Dp1, Dp2 located outside the lines 221 and 222 (the protruding area) before adjustment of ejection timing.

Figure 9:
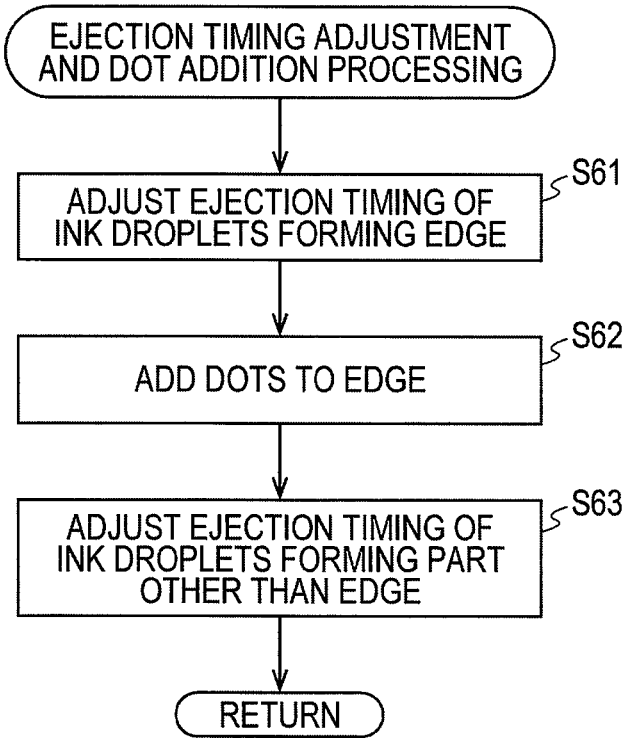
FIG. 9 is a flowchart showing the details of ejection timing adjustment and dot addition processing in FIG. 8.

The order of S62 and S63 described in FIG. 9 may be switched. Further, the order of S61 and S62 may be switched. Further, S62 and S63 may be skipped.

Figure 10:
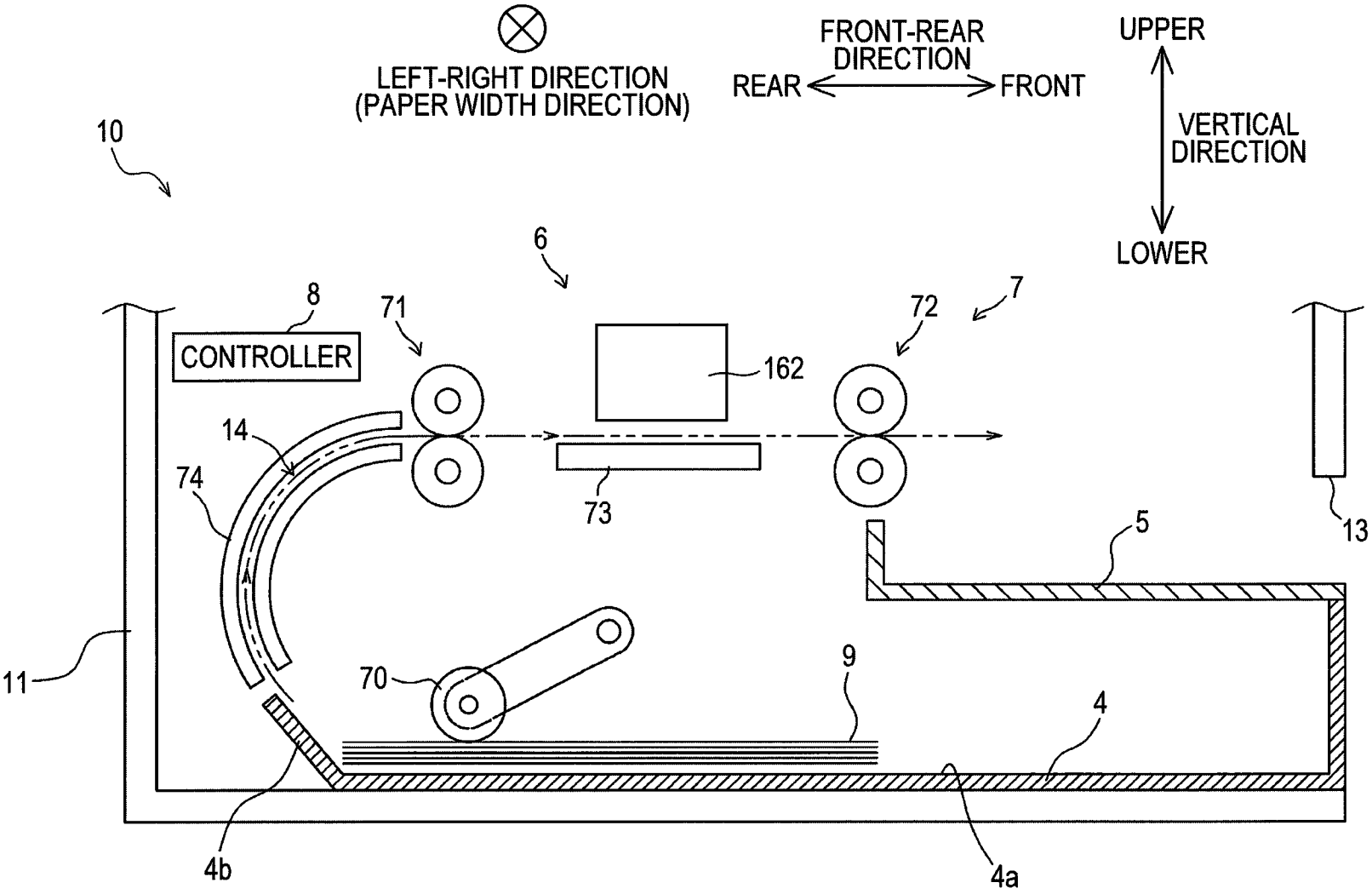
FIG. 10 is a schematic side view showing the internal structure of a printer having a line head according to a modification.

In the above-described embodiment, the printer 10 is a serial printer including the carriage 61 that reciprocates in the scanning direction along the two guide rails 65*a* and 65*b*, the head 62 being mounted on the carriage 61. Alternatively, as shown in FIG. 10, the present disclosure may be applied to a line head printer that includes a fixed head 162 having a length greater than or equal to the width of the paper 9, and that records an image by ejecting ink from the head 162 while conveying the paper 9 in the conveyance direction. In the case of the line head printer, in S3 of FIG. 8, the controller 8 determines whether the facing direction of the adjacent recorded regions 100*a* in the one-dimensional code image 100 is the same as the conveyance direction (FIG. 4A).

In the above-described embodiment, the one-dimensional code image is recorded on paper, but a two-dimensional code image such as a QR Code™ may be recorded. In that case, the effect of ensuring the recording quality applies to the scanning direction in the case of a serial printer, and applies to the conveyance direction in the case of a line printer.

The present disclosure may be applied not only to a code image but also to an image that includes a straight line portion at the boundary between a recorded region and a non-recorded region (for example, an image that includes ruled lines). In that case, in the first determination processing, it is determined whether a straight line portion is included at the boundary between the recorded region and the non-recorded region of the image to be recorded on a recording medium, instead of determining whether a code image formed by a plurality of recorded regions and a plurality of non-recorded regions is included in the image to be recorded on the recording medium.

In the above-described embodiment, the controller 8 provided in the printer 10 executes the extraction processing, the first to fourth determination processing, the recording processing, and so on, but the present disclosure is not limited to this. For example, a printer driver installed in the HDD of the PC 20 connected to the printer 10 or in the ROM of the mobile terminal may cause the PC 20 or the mobile terminal to execute some or all of these processing.

In the above-described embodiment, the present disclosure is applied to the printer 10, but the present disclosure is not limited to this. The present disclosure may also be applied to any inkjet recording apparatus that ejects ink from a head, such as a multifunction peripheral and a copier.

What is claimed is:

1. An inkjet recording apparatus comprising:

a head having a plurality of nozzles configured to eject ink droplets onto a recording medium;

a carriage on which the head is mounted, the carriage being configured to reciprocate in a first direction such that the head moves relative to the recording medium;

a conveyor configured to convey the recording medium in a second direction perpendicular to the first direction;

a memory; and a controller configured to:

extract an image resolution in the first direction of image data stored in the memory;

determine, based on the image data, whether a straight line portion is included in a boundary between a recorded region and a non-recorded region of an image to be recorded on the recording medium;

in response to determining that the straight line portion is included, determine whether the first direction is perpendicular to an extending direction of the straight line portion;

determine whether a recording resolution in the first direction is lower than the extracted image resolution, the recording resolution being stored in the memory;

in response to determining that the first direction is perpendicular to the extending direction and that the recording resolution is lower than the extracted image resolution, determine whether at least part of a predicted landing region is located outside a reference line, the predicted landing region being a landing region on the recording medium of an ink droplet forming an edge of the straight line portion of the recorded region assuming that the image is recorded with the recording resolution, the reference line being defined by ink droplets forming the edge of the straight line portion assuming that the image is recorded with a higher resolution than the recording resolution stored in the memory; and in response to determining that the at least part of the predicted landing region is located outside the reference line, control the head and the carriage to adjust ejection timing of the ink droplet forming the edge of the straight line portion such that a protruding area of an actual landing region of the ink droplet is smaller than a protruding area of the predicted landing region, the protruding area being an area located outside the reference line.

2. The inkjet recording apparatus according to claim 1, wherein the reference line is a straight line that is adjacent to or in contact with outer ends of landing regions of the ink droplets forming the edge of the straight line portion assuming that the image is recorded with a same resolution as the extracted image resolution, the straight line extending in the second direction.

3. The inkjet recording apparatus according to claim 1, wherein the controller is configured to, in response to determining that at least part of the predicted landing region is located outside the reference line, adjust ejection timing of a plurality of ink droplets forming the straight line portion such that actual landing regions of a plurality of ink droplets that land on same positions with respect to the second direction are arranged at equal intervals in the first direction.

4. The inkjet recording apparatus according to claim 1, wherein the controller is configured to, in response to determining that the at least part of the predicted landing region is located outside the reference line, increase a number of ink droplets forming the edge of the straight line portion such that a plurality of ink droplets forming the edge of the straight line portion are arranged at same intervals as a plurality of ink droplets forming a non-edge part of the straight line portion in the second direction.

5. The inkjet recording apparatus according to claim 1, wherein the image is a one-dimensional code image having a pattern in which the recorded region and the non-recorded region are formed alternately, each of the recorded region and the non-recorded region extending in the second direction; and wherein the controller is configured to, when determining whether the straight line portion is included, determine whether the one-dimensional code image is included in the image to be recorded on the recording medium.

6. The inkjet recording apparatus according to claim 1, wherein the controller is configured to, in response to determining that the at least part of the predicted landing region is located outside the reference line, control the head and the carriage to adjust ejection timing of the ink droplets forming the edge of the straight line portion such that an entirety of each of actual landing regions of the ink droplets is located inside the reference line.

7. A non-transitory computer-readable storage medium storing a set of program instructions for a computer of an electronic device that controls an inkjet recording apparatus, the set of program instructions, when executed by the computer, causing the electronic device to:

extract an image resolution in a first direction of image data stored in a memory of the electronic device, the inkjet recording apparatus including a head having a plurality of nozzles for ejecting ink droplets onto a recording medium and a movement mechanism configured to cause at least one of the head and the recording medium to move in the first direction such that the head moves relative to the recording medium;

determine, based on the image data, whether a straight line portion is included in a boundary between a recorded region and a non-recorded region of an image to be recorded on the recording medium;

in response to determining that the straight line portion is included, determine whether the first direction is perpendicular to an extending direction of the straight line portion;

determine whether a recording resolution in the first direction is lower than the extracted image resolution, the recording resolution being stored in the memory;

in response to determining that the first direction is perpendicular to the extending direction and that the recording resolution is lower than the extracted image resolution, determine whether at least part of a predicted landing region is located outside a reference line, the predicted landing region being a landing region on the recording medium of an ink droplet forming an edge of the straight line portion of the recorded region assuming that the image is recorded with the recording resolution, the reference line being defined by ink droplets forming the edge of the straight line portion assuming that the image is recorded with a higher resolution than the recording resolution stored in the memory; and in response to determining that the at least part of the predicted landing region is located outside the reference line, control the head and the carriage to adjust ejection timing of the ink droplet forming the edge of the straight line portion such that a protruding area of an actual landing region of the ink droplet is smaller than a protruding area of the predicted landing region, the protruding area being an area located outside the reference line.

8. The non-transitory computer-readable storage medium according to claim 7, wherein the reference line is a straight line that is adjacent to or in contact with outer ends of landing regions of the ink droplets forming the edge of the straight line portion assuming that the image is recorded with a same resolution as the extracted image resolution, the straight line extending in the second direction.

9. The non-transitory computer-readable storage medium according to claim 7, wherein the set of program instructions, when executed by the computer, causes the electronic device to, in response to determining that at least part of the predicted landing region is located outside the reference line, adjust ejection timing of a plurality of ink droplets forming the straight line portion such that actual landing regions of a plurality of ink droplets that land on same positions with respect to the second direction are arranged at equal intervals in the first direction.

10. The non-transitory computer-readable storage medium according to claim 7, wherein the set of program instructions, when executed by the computer, causes the electronic device to, in response to determining that the at least part of the predicted landing region is located outside the reference line, increase a number of ink droplets forming the edge of the straight line portion such that a plurality of ink droplets forming the edge of the straight line portion are arranged at same intervals as a plurality of ink droplets forming a non-edge part of the straight line portion in the second direction.

11. The non-transitory computer-readable storage medium according to claim 7, wherein the image is a one-dimensional code image having a pattern in which the recorded region and the non-recorded region are formed alternately, each of the recorded region and the non-recorded region extending in the second direction; and wherein the controller is configured to, when determining whether the straight line portion is included, determine whether the one-dimensional code image is included in the image to be recorded on the recording medium.

12. The non-transitory computer-readable storage medium according to claim 7, wherein the set of program instructions, when executed by the computer, causes the electronic device to, in response to determining that the at least part of the predicted landing region is located outside the reference line, control the head and the carriage to adjust ejection timing of the ink droplets forming the edge of the straight line portion such that an entirety of each of actual landing regions of the ink droplets is located inside the reference line.

13. An inkjet recording apparatus comprising:

a head configured to eject ink onto a recording medium, the head extending in a width direction of the recording medium;

a conveyor configured to convey the recording medium in a conveyance direction perpendicular to the width direction;

a memory; and a controller configured to:

extract an image resolution in the conveyance direction of image data stored in the memory;

determine, based on the image data, whether a straight line portion is included in a boundary between a recorded region and a non-recorded region of an image to be recorded on the recording medium;

in response to determining that the straight line portion is included, determine whether the conveyance direction is perpendicular to an extending direction of the straight line portion;

determine whether a recording resolution in the conveyance direction is lower than the extracted image resolution, the recording resolution being stored in the memory;

in response to determining that the conveyance direction is perpendicular to the extending direction and that the recording resolution is lower than the extracted image resolution, determine whether at least part of a predicted landing region is located outside a reference line, the predicted landing region being a landing region on the recording medium of an ink droplet forming an edge of the straight line portion of the recorded region assuming that the image is recorded with the recording resolution, the reference line being defined by ink droplets forming the edge of the straight line portion assuming that the image is recorded with a higher resolution than the recording resolution stored in the memory; and in response to determining that the at least part of the predicted landing region is located outside the reference line, control the head to adjust ejection timing of the ink droplet forming the edge of the straight line portion such that a protruding area of an actual landing region of the ink droplet is smaller than a protruding area of the predicted landing region, the protruding area being an area located outside the reference line.

* * * * *